US010544001B2

(12) United States Patent
Nadella et al.

(10) Patent No.: US 10,544,001 B2
(45) Date of Patent: Jan. 28, 2020

(54) SYSTEMS FOR UNWINDING A ROLL OF THERMOPLASTIC MATERIAL INTERLEAVED WITH A POROUS MATERIAL, AND RELATED METHODS

(71) Applicant: DART CONTAINER CORPORATION, Mason, MI (US)

(72) Inventors: Krishna V. Nadella, Redmond, WA (US); Alan Emerson, Mill Creek, WA (US)

(73) Assignee: Dart Container Corporation, Mason, MI (US)

( * ) Notice: Subject to any disclaimer, the term of this patent is extended or adjusted under 35 U.S.C. 154(b) by 193 days.

(21) Appl. No.: 15/720,595

(22) Filed: Sep. 29, 2017

(65) Prior Publication Data

US 2018/0022562 A1 Jan. 25, 2018

Related U.S. Application Data

(62) Division of application No. 14/760,357, filed as application No. PCT/US2014/011534 on Jan. 14, 2014, now Pat. No. 9,809,404.

(Continued)

(51) Int. Cl.
*B65H 16/04* (2006.01)
*B65H 18/02* (2006.01)

(Continued)

(52) U.S. Cl.
CPC ..... *B65H 16/04* (2013.01); *B65H 18/026* (2013.01); *B65H 23/0204* (2013.01);

(Continued)

(58) Field of Classification Search
CPC .. B65H 16/04; B65H 23/0204; B65H 23/044; B65H 23/048; B65H 23/32
See application file for complete search history.

(56) References Cited

U.S. PATENT DOCUMENTS 1,948,568 A 2/1934 Carroll
2,224,997 A 12/1940 Weisse (Continued)

FOREIGN PATENT DOCUMENTS

CA 2012985 9/1991
EP 0329490 A2 8/1989

(Continued)

OTHER PUBLICATIONS

European Search Report for Counterpart EP18177180.9, dated Aug. 2, 2018.

(Continued)

*Primary Examiner* — Sang K Kim
(74) *Attorney, Agent, or Firm* — McGarry Bair PC

(57) ABSTRACT

An apparatus (un-interleaver) for unwinding a roll of material interleaved with another material, and for separating the materials, includes a first platform, a second platform, a tension-sensor, an edge-sensor, and a controller. The controller monitors signals generated by the tension sensor and the edge sensor, and in response to the signals: a) causes the speed at which the second platform rotates to change to maintain a predetermined tension in the second material as the second material travels from the first platform toward the second platform, and b) causes the second platform to move relative to the first platform to align the edge of the second material traveling toward the roll of second material with the edge of the second material in the roll.

20 Claims, 6 Drawing Sheets

Related U.S. Application Data

(60) Provisional application No. 61/752,220, filed on Jan. 14, 2013.

(51) Int. Cl.

| | |
|---|---|
| ***B65H 23/182*** | (2006.01) |
| ***B65H 23/32*** | (2006.01) |
| ***B65H 23/04*** | (2006.01) |
| ***B65H 23/02*** | (2006.01) |
| ***B65H 23/18*** | (2006.01) |
| ***B65H 23/032*** | (2006.01) |
| ***B65H 23/195*** | (2006.01) |
| ***B65H 23/198*** | (2006.01) |

(52) U.S. Cl.

CPC ..... *B65H 23/0328* (2013.01); *B65H 23/044* (2013.01); *B65H 23/048* (2013.01); *B65H 23/1806* (2013.01); *B65H 23/1825* (2013.01); *B65H 23/198* (2013.01); *B65H 23/1955* (2013.01); *B65H 23/32* (2013.01); *B65H 2301/3251* (2013.01); *B65H 2301/4127* (2013.01); *B65H 2301/4131* (2013.01); *B65H 2701/1718* (2013.01); *B65H 2701/1752* (2013.01)

(56) References Cited

U.S. PATENT DOCUMENTS

| | | | |
|---|---|---|---|
| 2,317,448 | A | 4/1943 | Hill |
| 2,629,312 | A | 2/1953 | Davis |
| 2,755,029 | A | 7/1956 | Dwyer |
| 2,917,217 | A | 12/1959 | Sisson |
| 3,217,845 | A | 11/1965 | Faccin |
| 3,244,537 | A | 4/1966 | Cease |
| 3,260,781 | A | 7/1966 | Lux |
| 3,364,519 | A | 1/1968 | Pitsch |
| 3,557,265 | A | 1/1971 | Douglas |
| 3,610,000 | A | 10/1971 | Lopata |
| 3,617,311 | A | 11/1971 | Beltle |
| 3,744,402 | A | 7/1973 | Leofsky |
| 3,803,332 | A | 4/1974 | Austin |
| 3,836,624 | A | 9/1974 | Ferris |
| 3,845,915 | A | 11/1974 | Lumb |
| 3,846,526 | A | 11/1974 | Wade |
| 3,883,625 | A | 5/1975 | Cleereman |
| 3,895,911 | A | 7/1975 | Prins |
| 3,923,556 | A | 12/1975 | Iszczukiewicz |
| 3,937,777 | A | 2/1976 | Wienand |
| 3,955,482 | A | 5/1976 | Moen |
| 3,978,260 | A | 8/1976 | Dobbins |
| 4,003,184 | A | 1/1977 | Shiu |
| 4,059,660 | A | 11/1977 | Roth |
| 4,074,941 | A | 2/1978 | Jablonski |
| 4,188,432 | A | 2/1980 | Holden |
| 4,284,596 | A | 8/1981 | Inokuchi |
| 4,304,747 | A | 12/1981 | Lake |
| 4,335,606 | A | 6/1982 | Michalak |
| 4,386,188 | A | 5/1983 | Grancio |
| 4,424,287 | A | 1/1984 | Johnson |
| 4,456,571 | A | 6/1984 | Johnson |
| 4,473,665 | A | 9/1984 | Martini-Vvedensky |
| D277,632 | S | 2/1985 | Staufenberg |
| 4,511,520 | A | 4/1985 | Bowen |
| 4,552,789 | A | 11/1985 | Winchell |
| 4,608,009 | A | 8/1986 | Whiteside |
| 4,616,991 | A | 10/1986 | Bach |
| 4,632,862 | A | 12/1986 | Mullen |
| 4,673,695 | A | 6/1987 | Aubert |
| 4,693,856 | A | 9/1987 | Rubens |
| 4,756,091 | A | 7/1988 | Van Denend |
| 4,761,256 | A | 8/1988 | Hardenbrook |
| 4,848,543 | A | 7/1989 | Doboze |
| 4,886,563 | A | 12/1989 | Bennett |
| 4,894,248 | A | 1/1990 | Pappas |
| 4,911,869 | A | 3/1990 | Meyer |
| 4,981,631 | A | 1/1991 | Cheung |
| 5,047,280 | A | 9/1991 | Bach |
| 5,128,202 | A | 7/1992 | Subramanian |
| 5,145,107 | A | 9/1992 | Silver |
| 5,158,986 | A | 10/1992 | Cha |
| 5,160,098 | A | 11/1992 | Durkos |
| 5,172,443 | A | 12/1992 | Christ |
| 5,182,307 | A | 1/1993 | Kumar |
| 5,207,008 | A | 5/1993 | Wimberger |
| 5,217,660 | A | 6/1993 | Howard |
| 5,223,545 | A | 6/1993 | Kumar |
| 5,275,544 | A | 1/1994 | Marlowe |
| 5,303,484 | A | 4/1994 | Hagen |
| 5,330,126 | A | 7/1994 | Grischenko |
| 5,334,356 | A | 8/1994 | Baldwin |
| 5,362,436 | A | 11/1994 | Wagner |
| 5,364,696 | A | 11/1994 | Wagner |
| 5,369,135 | A | 11/1994 | Campbell |
| 5,437,846 | A | 8/1995 | Roumagnac |
| 5,484,640 | A | 1/1996 | Mullen |
| 5,589,243 | A | 12/1996 | Day |
| 5,640,784 | A | 6/1997 | Rocheleau |
| 5,684,055 | A | 11/1997 | Kumar et al. |
| 5,723,510 | A | 3/1998 | Kabumoto |
| 5,747,085 | A | 5/1998 | Veltman |
| 5,783,610 | A | 7/1998 | Fukushima |
| 5,792,295 | A | 8/1998 | Huebner |
| 5,835,657 | A | 11/1998 | Suarez |
| 5,844,731 | A | 12/1998 | Kabumoto |
| 5,846,582 | A | 12/1998 | Mayfield |
| 5,867,920 | A | 2/1999 | Rogne |
| 5,894,046 | A | 4/1999 | Kim |
| 5,904,946 | A | 5/1999 | Kemp |
| 5,955,014 | A | 9/1999 | Raukola |
| 6,012,583 | A | 1/2000 | Ramirez |
| 6,025,049 | A | 2/2000 | Ouellette |
| 6,074,678 | A | 6/2000 | Blackwelder |
| 6,083,580 | A | 7/2000 | Finestone |
| 6,102,313 | A | 8/2000 | Salzsauler et al. |
| 6,235,380 | B1 | 5/2001 | Tupil |
| 6,365,249 | B1 | 4/2002 | Al Ghatta |
| 6,403,663 | B1 | 6/2002 | DeSimone |
| D476,861 | S | 7/2003 | Zettle |
| 6,656,671 | B1 | 12/2003 | Aylward |
| 6,773,791 | B1 | 8/2004 | Ruggie |
| 6,884,377 | B1 | 4/2005 | Burnham |
| 6,884,823 | B1 | 4/2005 | Pierick |
| 6,948,378 | B2 | 9/2005 | Solberg |
| 6,979,494 | B2 | 12/2005 | Berrier |
| 7,041,187 | B2 | 5/2006 | Park |
| 7,083,849 | B1 | 8/2006 | Albrecht |
| 7,364,659 | B2 | 4/2008 | Jang |
| 8,076,616 | B2 | 12/2011 | Stanger |
| 8,646,385 | B2 * | 2/2014 | McLaughlin ..... B41J 15/165 101/228 |
| 2001/0020513 | A1 | 9/2001 | Tupil |
| 2001/0032903 | A1 | 10/2001 | Durrance et al. |
| 2002/0168509 | A1 | 11/2002 | DeSimone |
| 2003/0130364 | A1 | 7/2003 | Vo |
| 2003/0138570 | A1 | 7/2003 | Kaylor |
| 2004/0005449 | A1 | 1/2004 | Sugimoto |
| 2004/0127125 | A1 * | 7/2004 | Kornett ..... D21F 1/0054 442/181 |
| 2004/0250628 | A1 | 12/2004 | Solberg |
| 2005/0035495 | A1 | 2/2005 | Baker |
| 2005/0058824 | A1 | 3/2005 | Fujimoto |
| 2005/0115975 | A1 | 6/2005 | Smith |
| 2005/0181196 | A1 | 8/2005 | Aylward |
| 2005/0203198 | A1 | 9/2005 | Branch |
| 2005/0214512 | A1 | 9/2005 | Fascio |
| 2005/0233036 | A1 | 10/2005 | Feldmeier |
| 2006/0073298 | A1 | 4/2006 | Hutchinson |
| 2006/0144915 | A1 | 7/2006 | Sadlier |
| 2007/0087089 | A1 | 4/2007 | Heymann |
| 2007/0109382 | A1 | 5/2007 | Lafleche |
| 2007/0148432 | A1 | 6/2007 | Baker |
| 2007/0292807 | A1 | 12/2007 | Campbell |

(56) References Cited

U.S. PATENT DOCUMENTS

| | | | |
|---|---|---|---|
| 2008/0087715 | A1 | 4/2008 | Robertson |
| 2008/0274346 | A1 | 11/2008 | Miller |
| 2008/0277817 | A1 | 11/2008 | Miller |
| 2008/0280123 | A1 | 11/2008 | Miller |
| 2009/0035596 | A1 | 2/2009 | Higashi |
| 2009/0065136 | A1 | 3/2009 | Nadella |
| 2009/0104420 | A1 | 4/2009 | Nadella |
| 2009/0309250 | A1 | 12/2009 | Nadella |
| 2010/0028654 | A1 | 2/2010 | Takase |
| 2010/0062235 | A1 | 3/2010 | Nadella |
| 2010/0112301 | A1 | 5/2010 | Powers |
| 2010/0163450 | A1 | 7/2010 | Branch |
| 2011/0000948 | A1 | 1/2011 | Fuwa |
| 2011/0081524 | A1 | 4/2011 | Nadella |
| 2011/0101083 | A1 | 5/2011 | Matsuzaki |
| 2011/0195165 | A1 | 8/2011 | Cahill |
| 2011/0251060 | A1 | 10/2011 | Harrison |
| 2012/0006480 | A1 | 1/2012 | Ohya |
| 2012/0267814 | A1 | 10/2012 | Branch et al. |

FOREIGN PATENT DOCUMENTS

| | | | |
|---|---|---|---|
| EP | 0371392 | A2 | 6/1990 |
| EP | 0832818 | A1 | 4/1998 |
| EP | 0922692 | A1 | 6/1999 |
| EP | 1055499 | A1 | 11/2000 |
| EP | 1526093 | A2 | 4/2005 |
| GB | 2044672 | A1 | 10/1980 |
| JP | 08174648 | | 7/1966 |
| JP | 07117918 | A | 5/1995 |
| JP | 11080408 | A2 | 3/1999 |
| JP | 2000280442 | A | 10/2000 |
| JP | 2001180858 | A | 7/2001 |
| JP | 2002128350 | A | 5/2002 |
| JP | 2004193259 | A | 7/2004 |
| JP | 2007050600 | A | 3/2007 |
| JP | 2008100841 | A | 5/2008 |
| JP | 2008137211 | A | 6/2008 |
| JP | 2009091157 | A | 4/2009 |
| JP | 2009126079 | A2 | 6/2009 |
| JP | 2012166940 | A | 9/2012 |
| WO | 9618486 | A2 | 6/1996 |
| WO | 9721377 | A1 | 6/1997 |
| WO | 00/06478 | A1 | 2/2000 |
| WO | 0105574 | A1 | 1/2001 |
| WO | 0136521 | A2 | 5/2001 |
| WO | 04103675 | A1 | 12/2004 |
| WO | 04103828 | A2 | 12/2004 |
| WO | 04104072 | A2 | 12/2004 |
| WO | 09036328 | A2 | 3/2009 |
| WO | 10012353 | A1 | 2/2010 |
| WO | 11133568 | A1 | 10/2011 |
| WO | 2012074979 | A1 | 6/2012 |

OTHER PUBLICATIONS

International Search Report and the Written Opinion of the International Searching Authority for Counterpart PCT/US2014/011534, dated May 12, 2014.

European Search Report for Counterpart EP14737939.0, dated Jun. 16, 2016.

* cited by examiner

SYSTEMS FOR UNWINDING A ROLL OF THERMOPLASTIC MATERIAL INTERLEAVED WITH A POROUS MATERIAL, AND RELATED METHODS

CROSS REFERENCE TO RELATED APPLICATIONS

This application is a divisional of U.S. patent application Ser. No. 14/760,357, filed Jul. 10, 2015, now U.S. Pat. No. 9,809,404, issued Nov. 7, 2017, which claims the benefit of International Application No. PCT/US2014/011534, filed Jan. 14, 2014, which application claims the benefit of U.S. Provisional Patent Application 61/752,220, filed Jan. 14, 2013, and titled "APPARATUSES AND METHODS FOR A VERTICAL ROLL UNINTERLEAVING SYSTEM," all of which are herein incorporated by reference in their entirety.

BACKGROUND

Solid-state foaming of a thermoplastic material is a process for generating a microstructure in the material that includes many small bubbles or voids. The process includes exposing the material to an atmosphere of a gas at an elevated pressure for a period of time to infuse the gas into the material. After the material has absorbed enough gas, the material is exposed to an atmosphere having less pressure, and is heated, but not melted, to cause the gas in the material to nucleate bubbles. When the bubbles have grown to a desired size, or when a specific amount of bubbles have nucleated, the material is cooled. Because the material remains a solid (does not melt) during the whole process, the material is foamed in the solid state.

Because, it takes time for enough gas in the pressurized atmosphere to infuse the thermoplastic material, the solid-state foaming process is typically done as a batch process—that is, not as a continuous process. To maximize the amount of material that can be processed during a single batch, the thermoplastic material is formed into a sheet and wound onto a roll (10 in FIGS. 1A and 1B). To promote gas infusion into all layers of the roll 10, and thus reduce the period of time that the thermoplastic material is exposed to the gas, a sheet of a gas-permeable material is interleaved between each layer of the thermoplastic material in the roll 10. The gas-permeable material promotes gas infusion throughout the whole, rolled-up thermoplastic material by keeping each of the layers of the roll 10 separated and by allowing easy passage of the gas throughout the gas-permeable sheet's microstructure to expose all of the rolled-up thermoplastic polymer material.

Rolls of thermoplastic material interleaved with gas-permeable material are typically large in diameter and weigh several hundred pounds. Because of their size and weight, such rolls are often formed in a horizontal position as shown in FIG. 1A. In the horizontal position, one can more securely support and maneuver the roll 10 by holding onto the hub 12 because the weight of the roll 10 is supported at both ends 14*a* and 14*b* of the hub 12.

After the whole, rolled-up thermoplastic material has been infused with a desired amount of gas, the thermoplastic material is then unwound from the roll and directed through an oven to heat the material to cause the gas in the material to nucleate bubbles. Unfortunately, unwinding the roll 10 in a horizontal position can cause problems. When the roll 10 is unwound in the horizontal position, the thermoplastic material can experience a fluctuation in tension. If the roll 10 becomes unbalanced, then as the heavier region 18 travels up during the roll's rotation, one must exert more force on the layer being pulled off the roll 10 to counter the heavier region's resistance to the roll's rotation. And, as the heavier region 18 travels down during the roll's rotation, one must exert less force on the layer being pulled off the roll 10 to counter the heavier region 18 urging the roll 10 to rotate faster. This fluctuation in the tension of the thermoplastic polymer material can cause the material to warp or fold as the material is foamed.

SUMMARY

In an aspect of the invention, an apparatus (un-interleaver) for unwinding a roll of material interleaved with another material, and for separating the materials, includes a first platform and a second platform. The first platform is configured to hold a roll of first material interleaved with a second material such that a longitudinal axis of the roll is vertical or substantially vertical, and to rotate to unwind the first and second materials from the roll. The second platform is configured to hold a roll of the second material, and to rotate to wind the unwound second material onto the roll while the first platform rotates to unwind the first and second materials. The apparatus also includes a tension-sensor, an edge-sensor, and a controller. The tension-sensor generates a signal that represents an amount of tension in the second material as the second material travels from the first platform toward the second platform. The edge-sensor generates a signal that represents the position of an edge of the second material as the second material travels from the first platform toward the second platform. The controller monitors the signal generated by the tension-sensor and the signal generated by the edge-sensor. And, in response to the monitored signals, the controller: a) causes the speed at which the second platform rotates to change to maintain a predetermined tension in the second material as the second material travels from the first platform toward the second platform, and b) causes the second platform to move relative to the first platform to align the edge of the second material traveling toward the roll of second material with the edge of the second material in the roll.

By unwinding, in a vertical position, the roll of the first material interleaved with the second material, one can avoid fluctuations in tension in the first material as the first material is directed toward subsequent processing, such as an oven where the first material may be heated. And, by monitoring the tension in the second material unwound from the roll, and in response, changing the rotational speed of the second platform, one can change the rotational speed of the first platform without adversely affecting the collection of the second material. The ability to change the speed of the first platform allows one to increase and/or decrease tension in the unwound first material, which may be caused by subsequent processing, to maintain a predetermined tension in the unwound first material. In addition, by monitoring the position of the second material's edge as the unwound second material travels toward the roll of second material held by the second platform, one can quickly and efficiently collect the second material unwound from the roll of first material interleaved with the second material, and easily re-use the second material.

In another aspect of the invention, an apparatus (turnbar) for changing the orientation of a sheet of material as the material travels from a first location toward a second location, includes a first roller, a second roller, and a turnbar-roller disposed between the first roller and the second roller. The first roller is configured to support a sheet of material in a first orientation as the material travels from a first location toward a second location. The second roller is configured to support the sheet of material in a second orientation, as the material travels toward the second location. And, the turnbar-roller is configured to support the sheet of material in a third orientation that is intermediate to the first and second orientations, and is movable relative to the first roller to maintain a predetermined tension in the sheet of material, as the material travels toward the second location.

By supporting the sheet of material in a third orientation that is intermediate to the first and second orientations, one can more easily change the orientation of the sheet to an orientation that is substantially different than the first orientation. For example, one can change the orientation of a sheet from a vertical orientation, like that found in the first material as the first material is unwound by the un-interleaver apparatus, to a horizontal orientation. And, by moving the turnbar-roller relative to the first roller, one can increase and/or decrease tension in the sheet of material to maintain a predetermined tension in the sheet, as the material travels toward the second location. By moving the turnbar-roller relative to the first roller, one can also use the turnbar apparatus to change the orientation of different sheets, each having different widths, without changing the location of each sheet's centerline. For example, one may use the turnbar to change the orientation of a sheet whose width is 51 inches and whose centerline is located in the middle of the second roller. Then, after that is completed, one may move the turnbar-roller away from the first roller and use the turnbar to change the orientation of a sheet whose width is 24 inches and whose centerline is also located in the middle of the second roller.

DETAILED DESCRIPTION

Figure 1A:
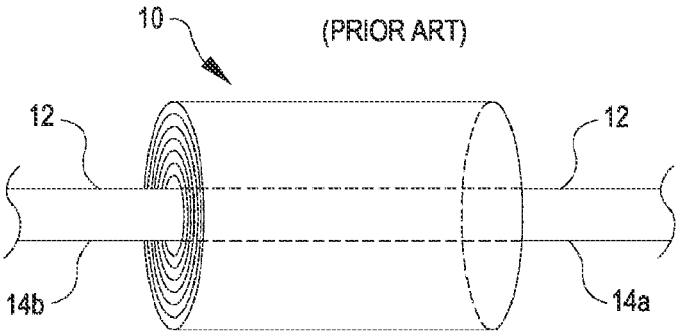
FIG. 1A (PRIOR ART)
FIGS. 1A and 1B are views of a thermoplastic polymer roll interleaved with a gas-permeable material oriented in a horizontal position.
Figure 1B:
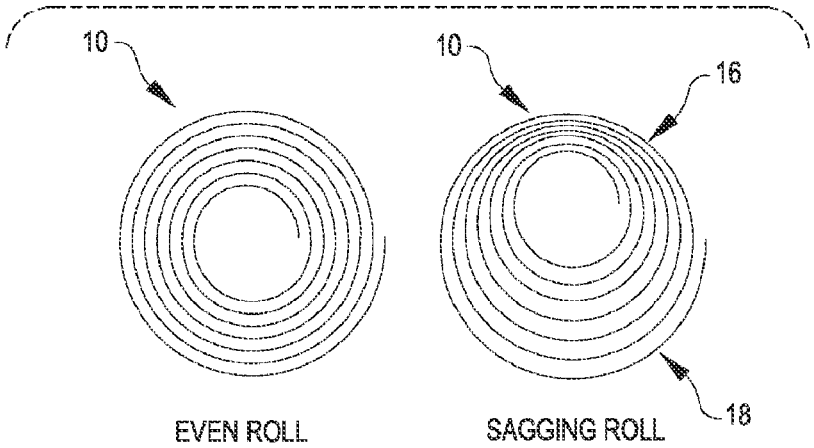
FIG. 1B (PRIOR ART)
Figure 2:
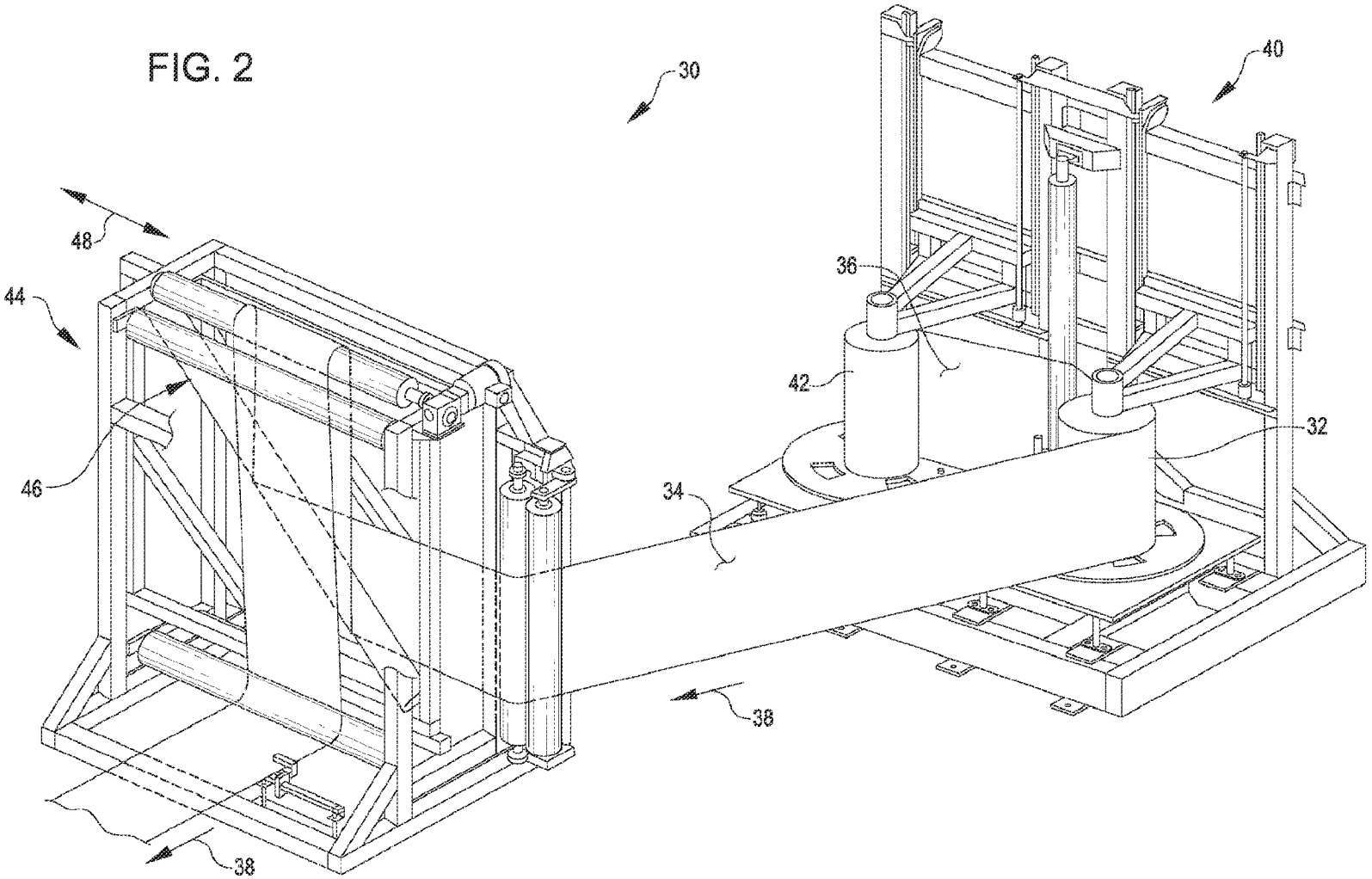
FIG. 2 is a perspective view of a system, according to an embodiment of the invention.
Figure 4A:
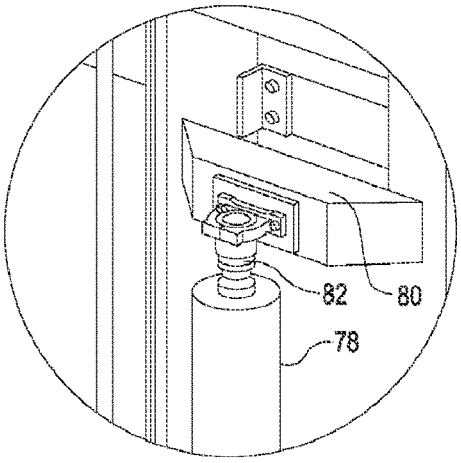
FIGS. 4A and 4B are perspective, partial views of a tension-sensor included in the un-interleaver shown in FIG. 3, according to an embodiment of the invention.
Figure 4B:
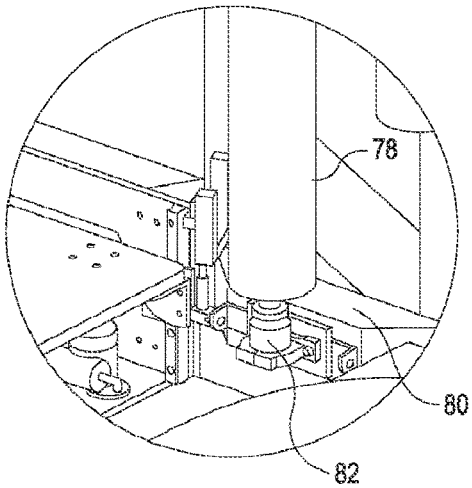
Figure 5:
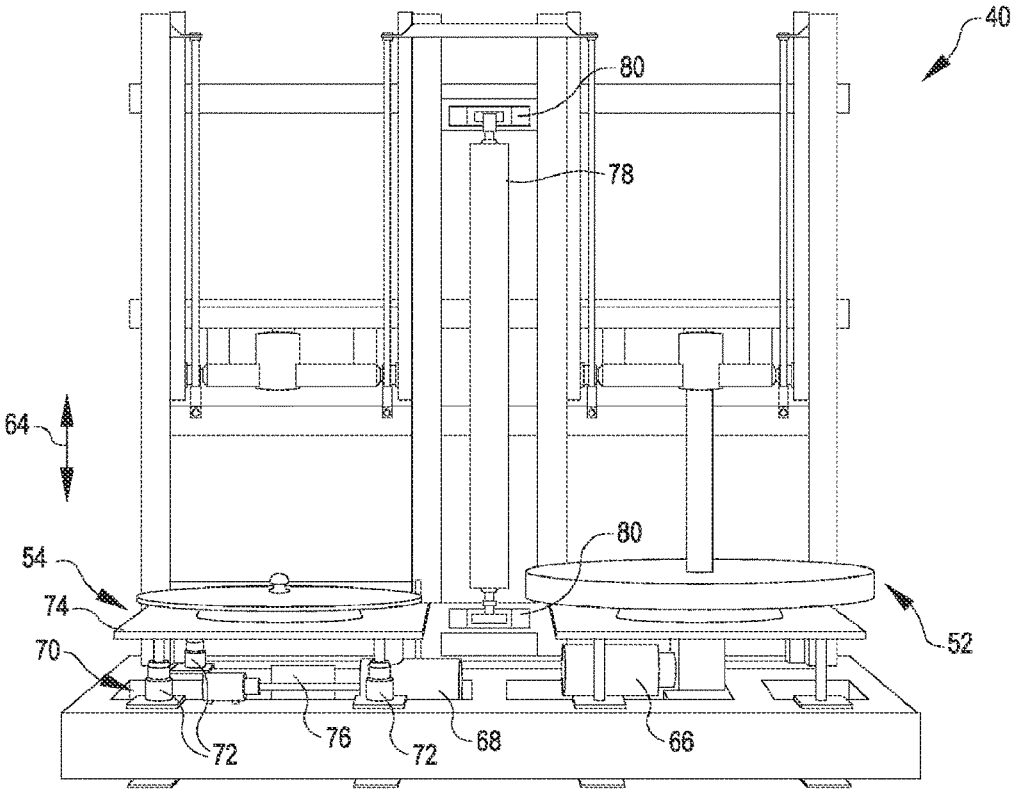
FIG. 5 is another view of the un-interleaver shown in FIG. 3, according to an embodiment of the invention.

FIG. 2 is a perspective view of a system 30, according to an embodiment of the invention. The system 30 unwinds a roll 32 of material 34 (here a thermoplastic material) interleaved with another material 36 (here a gas-permeable material), separates the materials 34 and 36, and changes the orientation of a sheet of one of the materials 34 as the material 34 travels downstream (indicated by arrows 38) for further processing, such as heating in an oven. The system 30 includes an un-interleaver apparatus 40 (discussed in greater detail in conjunction with FIGS. 3-5) for unwinding the roll 32 in a vertical position (shown) and separating the materials 34 and 36. The material 34 is directed toward subsequent processing, and the material 36 is collected on a roll 42 for future use.

By unwinding, in a vertical position, the roll 32 of the material 34 interleaved with the material 36, one can avoid fluctuations in tension in the material 34 (here the thermoplastic material) as the material 34 is directed toward subsequent processing, such as an oven where the material 34 may be heated. This helps prevent physical damage to the material 34, which often adversely affects subsequent processing of the material 34 and/or the product (not shown) produced by the subsequent processing. Avoiding fluctuations in tension in the material 34 also allows one to more easily maintain a predetermined tension, which may be zero tension, in the material 34 as the material 34 travels toward subsequent processing and is subsequently processed.

Figure 7:
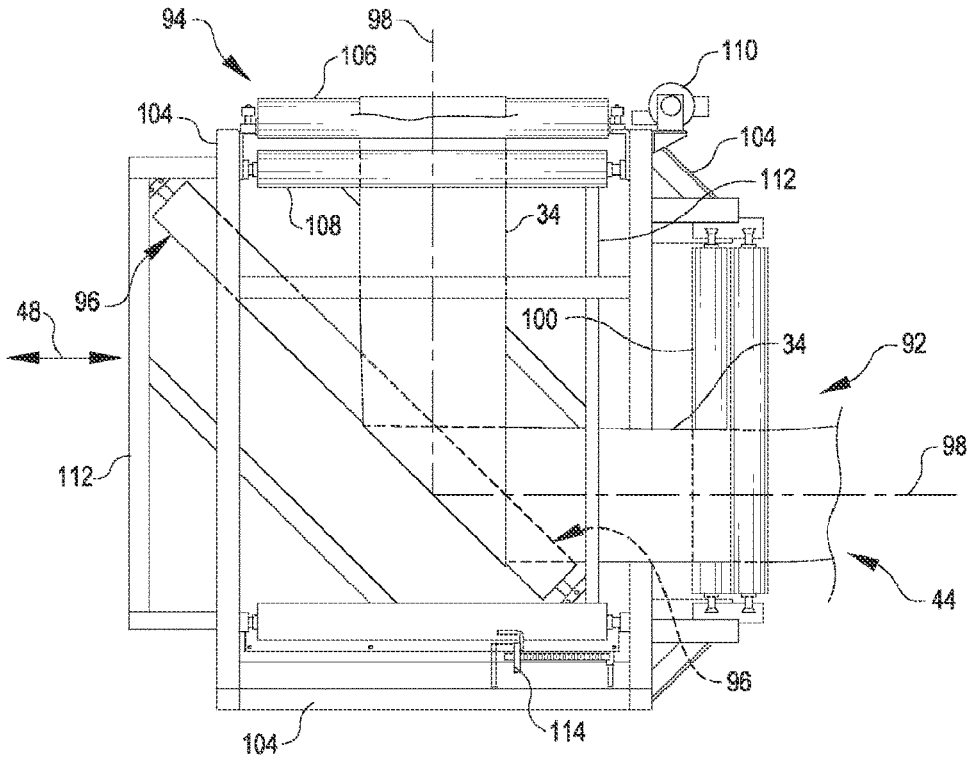
FIG. 7 is a view of the turnbar shown in FIG. 6 with the turnbar's turnbar-roller located at a first position.
Figure 8:
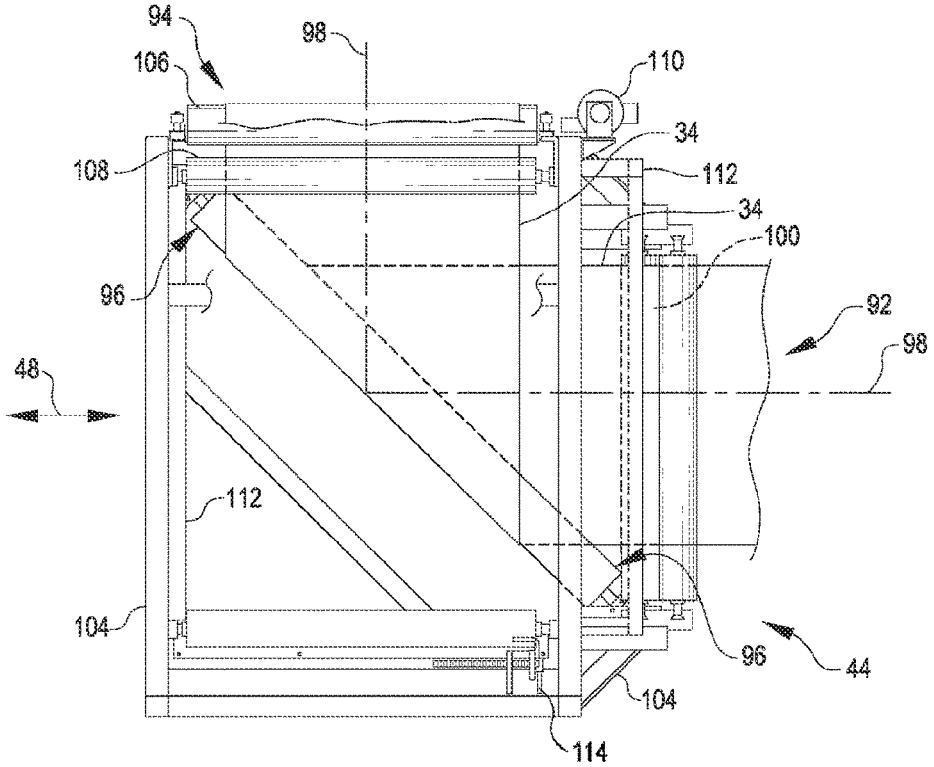
FIG. 8 is a view of the turnbar shown in FIG. 6 with the turnbar's turnbar-roller located at a second position.

The system 30 also includes a turnbar apparatus 44 (discussed in greater detail in conjunction with FIGS. 6-8) for changing the orientation of a sheet of one of the materials 34 from a first orientation (here vertical) to a second orientation (here horizontal) by supporting the sheet of material 34 in a third orientation (here halfway between vertical and horizontal) that is intermediate to the first and second orientations. To support the sheet of material 34 in the third orientation, the turnbar apparatus 44 includes a turnbar-roller 46 that is moveable in the directions indicated by the two-headed arrow 48.

By supporting the sheet of material 34 in a third orientation that is intermediate to the first and second orientations, one can more easily change the orientation of the sheet to an orientation that is substantially different than the first orientation. For example, one can change the orientation of a sheet from a vertical orientation, like that found in the material 34 as the material 34 is unwound by the un-interleaver apparatus 40, to a horizontal orientation. And, by moving the turnbar-roller 46 in one of the directions indicated by the arrow 48, one can increase and/or decrease tension in the sheet of material 34 to maintain a predetermined tension in the sheet, as the material 34 travels toward subsequent processing. By moving the turnbar-roller, one can also use the turnbar apparatus 44 to change the orientation of different sheets, each having different widths, without changing the location of each sheet's centerline (discussed in greater detail in conjunction with FIGS. 6-8).

Still referring to FIG. 2, the material 34 may be any desired material. For example, the material 34 may be a thermoplastic material that includes polyethylene terephthalate (PET). Additionally or alternatively the thermoplastic material may include one or more of the following: polystyrene, polycarbonate, acrylonitrile-butadiene styrene, glycol modified PET, polyethylene, polypropylene, NORYL (a blend of polyphenylene oxide and polystyrene), polyvinyl chloride, and crystallizable polyethylene terephthalate (CPET).

Similarly, the material 36 may be any desired material. For example, the material 36 may be a gas-permeable material that allows gas to easily flow through its microstructure. Examples of such a material include a conventional cellulose, a plastic having an open-cell microstructure, a nonwoven synthetic material, and a high-loft textile.

Figure 3:
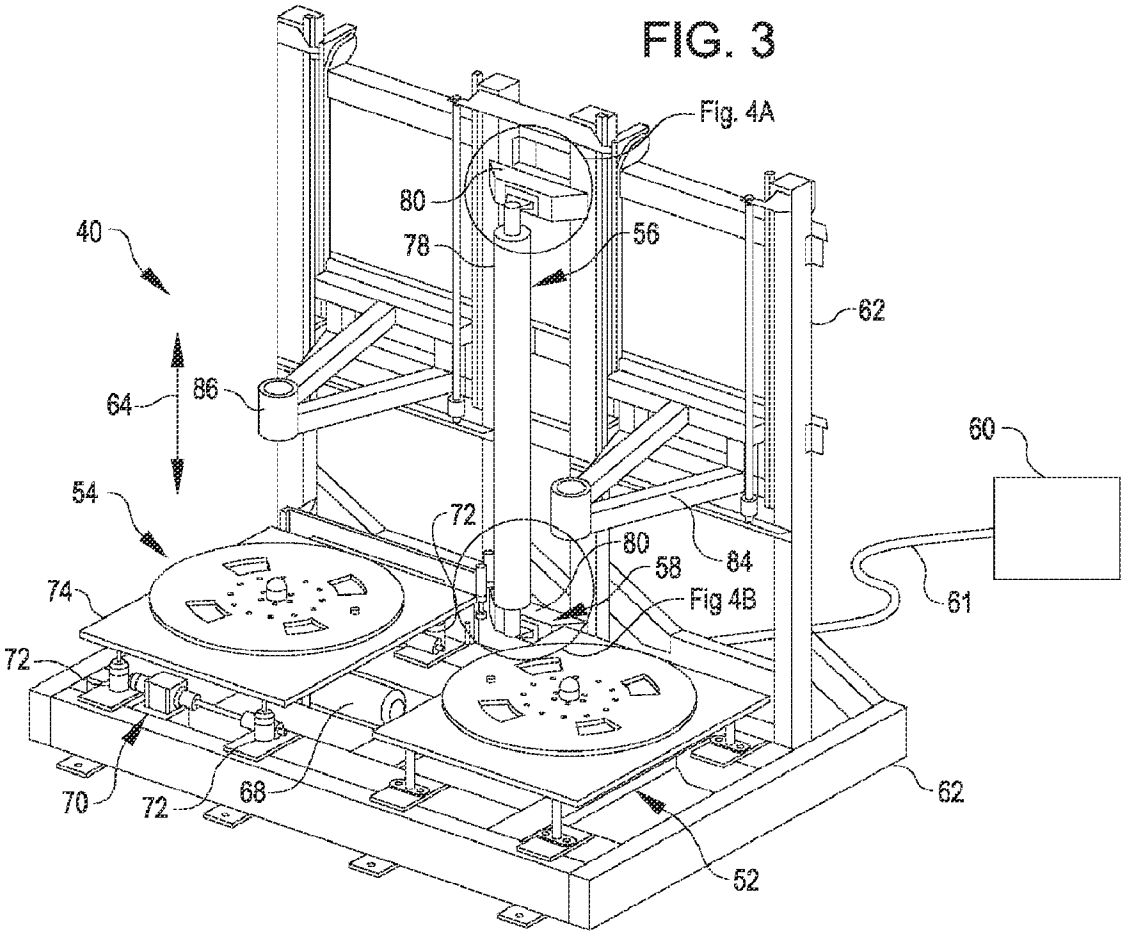
FIG. 3 is a perspective view of an un-interleaver included in the system shown in FIG. 2, according to an embodiment of the invention.

FIG. 3 is a perspective view of the un-interleaver apparatus 40 shown in FIG. 2, according to an embodiment of the invention. The un-interleaver apparatus 40 unwinds a vertically positioned roll (32 in FIG. 2) of material interleaved with another material, and separates the materials (34 and 36 in FIG. 2).

In this and other embodiments, the un-interleaver apparatus 40 includes a first platform 52 and a second platform 54. The first platform 52 is configured to hold the roll 32 of material 34 interleaved with material 36 such that a longitudinal axis (not shown) of the roll 32 is vertical or substantially vertical, and to rotate to unwind the materials 34 and 36 from the roll 32. The second platform 54 is configured to hold the roll 42 of material 36, and to rotate to wind the unwound material 36 onto the roll 42 as the material 36 is unwound from the roll 32. The un-interleaver apparatus 40 also includes a tension-sensor 56, an edge-sensor 58, and a controller 60. Although the controller 60 is shown away from the uninterleaver apparatus' frame 62 and coupled with a cable 61 to the platforms 52 and 54, the tension-sensor 56 and the edge-sensor 58, the controller 60 may also be located within the frame 62, if desired. The tension-sensor 56 generates a signal that represents an amount of tension in the material 36 as the material 36 travels from the first platform 52 toward the second platform 54. The edge-sensor 58 generates a signal that represents the position of an edge of the material 36 as the material 36 travels from the first platform 52 toward the second platform 54. The controller 60 monitors the signals generated by the tension-sensor 56 and the edge-sensor 58. And, in response to the monitored signals, the controller 60:

a) causes the rotational speed of the second platform 54 to change to maintain a predetermined tension in the material 36 as the material 36 travels from the first platform 52 toward the second platform, and b) causes the second platform 54 to move relative to the first platform 52 in the directions indicated by the two-headed arrow 64 to align the edge of the material 36 traveling toward the roll 42 with the edge of the material 36 in the roll 42.

Still referring to FIG. 3, the first platform 52 may hold the roll 32 in any desired position to minimize fluctuations in tension in the material 34 as the material is unwound from the roll 32. For example, in this and other embodiments, the first platform 52 holds the roll 32 in the vertical position. In other embodiments, the first platform 52 may hold the roll 32 in a substantially vertical position, or even in a canted position. Such a canted or off-vertical position may be wanted to provide a desired effect in the material 34 as the material is unwound from the roll 32.

In addition, the first platform 52 may rotate as desired to maintain a predetermined tension in the material 34 as the material travels toward subsequent processing. For example, in this and other embodiments, the apparatus 40 includes an induction motor 66 (shown in FIG. 5) whose operation is controlled by the controller 60. When the controller 60 allows power to flow through the motor 66, the motor 66 rotates the first platform 52 and thus the roll 32 held by the platform 52 in a clockwise direction to unwind material 34 from the roll 32. When the controller 60 prevents power from flowing through the motor 66, the first platform 52 is allowed to rotate freely. In this manner, the motor 66 does not oppose the rotation of the roll 32 if the material 34 is pulled off of the roll 32 by a device located downstream, such as the turnbar apparatus 44. Moreover, by selectively powering the motor 66, the controller 60 can cause the first platform 52, and thus the roll 32, to rotate faster in response to tension in the material 34 exceeding a predetermined tension. By rotating faster, the opposing force from friction in the platform's rotation and from the inertia of the roll 32 is reduced, and thus the tension in the material 34 is reduced. In other embodiments, a motor may be coupled to the first platform 52 via a clutch or other transmission that allows the platform to rotate freely when the motor does not rotate the platform 52.

The predetermined tension in the material 34 may be any desired tension.

For example in this and other embodiments, the predetermined tension is zero tension. In such embodiments, the material 34 is pulled and pushed off of the roll 32 with the same amount of force to prevent tension from generating in the material 34. In other embodiments, the predetermined tension may be 0.1 pounds. In still other embodiments, the predetermined tension may be more than 0.1 pounds.

Still referring to FIG. 3, the second platform 54 may hold the roll 42 in any desired position. For example, in this and other embodiments, the second platform 54 holds the roll 42 in a vertical position so that the roll 42 is parallel or substantially parallel to the roll 32. By holding the roll 42 parallel or substantially parallel to the other roll 32, one does not have to change the orientation of the sheet of material 36 before the material 36 is wound onto the roll 42. In other embodiments, the second platform 54 may hold the roll 42 in a position canted relative to the roll 32.

In addition, the second platform 54 may rotate as desired to maintain a predetermined tension in the material 36 as the material travels toward the roll 42. For example, in this and other embodiments, the un-interleaver apparatus 40 includes a servo motor 68 (also shown in FIG. 5) that rotates the second platform 54 counter-clockwise and whose operation is continuously controlled by the controller 60. The controller 60 determines whether or not to change the rotational speed of the roll 42 by monitoring the tension in the material 36 before the material 36 is wound onto the roll 42. When the controller 60 determines that the roll 42 needs to rotate faster to increase tension in the material 36, then the controller 60 directs the motor 68 to rotate the platform 54 faster. And, when the controller 60 determines that the roll 42 needs to rotate slower to decrease tension in the material 36, then the controller 60 directs the motor 68 to rotate the platform 54 slower. In other embodiments, the controller 60 may monitor the rotational speed of the first platform 52 and compare the speed to the rotational speed of the second platform. In such embodiments, the controller 60 must take into account both the diminishing diameter of the roll 32 as the roll 32 unwinds and the increasing diameter of the roll 42 as the roll 42 winds. As the roll 32 unwinds, the speed of the unwinding materials 34 and 36 decreases if the rotational speed of the roll 32 does not change; and as the roll 42 winds, the speed of the winding material 36 increases if the rotational speed of the roll 42 does not change. In other embodiments, a motor may be coupled to the first platform 52 via a clutch or other transmission that allows the platform to rotate freely when the motor does not rotate the platform 52.

By monitoring the tension in the material 36 unwound from the roll 32, and in response, changing the rotational speed of the second platform 54, one can change the rotational speed of the first platform 52 without adversely affecting the collection of the material 36. The ability to change the speed of the first platform 52 allows one to increase and/or decrease tension in the material 34 to maintain a predetermined tension in the material 34.

The predetermined tension in the material 36 may be any desired tension.

For example in this and other embodiments, the predetermined tension is zero tension. In such embodiments, the material 36 is pulled and pushed off of the roll 32 with the same amount of force to prevent tension from generating in the material 36. In other embodiments, the predetermined tension may be 0.1 pounds. In still other embodiments, the predetermined tension may be more than 0.1 pounds.

Still referring to FIG. 3, the second platform 54 may be supported on the frame 62 as desired to allow the platform 54 to move in the directions indicated by the arrows 64. For example, in this and other embodiments, the un-interleaver apparatus 40 includes a chassis 70 (also shown in FIG. 5). The chassis 70 includes a jack 72 located at each corner of a chassis plate 74, and a motor 76 (shown in FIG. 5) that causes one or more of the jacks 72 to extend or retract to move the chassis plate 74, and thus the the platform 54, in one of the directions indicated by the two-headed arrow 64. The controller 60 controls the operation of the motor 76 and determines whether or not to move the chassis plate 74 by monitoring the position of the edge of the material 36 as the unwound material 36 travels toward the roll 42. When the controller 60 determines that the roll 42 needs to move up to align the edge of the material 36 being wound onto the roll 42 with the edge of the roll 42, then the controller 60 directs the motor 76 to cause each of the jacks 72 to extend. And, when the controller 60 determines that the roll 42 needs to move down to align the edge of the material 36 being wound onto the roll 42 with the edge of the roll 42, then the controller 60 directs the motor 76 to cause each of the jacks 72 to retract. In other embodiments, the controller 60 may direct one or more of the jacks 72 to extend to cause the chassis plate 74, and thus the roll 42, to cant from its previous position.

By monitoring the position of the material's edge as the unwound material 36 travels toward the roll 42, one can quickly and efficiently collect the material 36 unwound from the roll 32, and easily re-use the material 36.

Still referring to FIG. 3, the tension-sensor 56 may be any desired sensor capable of generating a signal that the controller 60 can use to determine whether or not tension in the material 36 exceeds or falls below a predetermined tension. For example, in this and other embodiments, the tension-sensor 56 includes a roller 78 (also shown in FIGS. 4A, 4B and 5) that contacts the material 36 and rotates as the material 36 travels from the roll 32 to the roll 42. The roller 78 is mounted to the frame 60 by mounts 80, and is located such that the material 36 only contacts a portion of its curved surface as the material 36 travels toward the roll 42. In this configuration, the material 36 urges the roller 78 away from the frame 62 when tension exists in the material 36. To measure this tension in the material 36, a conventional sensor 82 (shown in FIGS. 4A and 4B), that senses displacement of the roller 78 relative to the mounts 80, is located where the roller 78 is coupled to each of the mounts 80. The sensor 82 converts the displacement of the roller 78 into a voltage that the controller reads and correlates to a specific tension.

The edge-sensor 58 may be any desired sensor capable of generating a signal that the controller 60 can use to determine whether or not the edge of the material 36 traveling toward the roll 42 will align with the edge of the roll 42 when the material 36 is wound around the roll 42. For example, in this and other embodiments, the edge-sensor 58 includes a conventional sensor (not shown) that senses changes in the location of the edge by monitoring changes in the light reflected from the edge.

The controller 60 may be any desired controller capable of processing the signals from the tension-sensor 56 and the edge-sensor 58, and in response directing changes to the operation of the un-interleaver apparatus 40. For example in this and other embodiments, the controller 60 may be a computer that includes memory circuitry, processor circuitry, and software that the processor circuitry executes to perform its monitoring, determining, and directing functions.

Still referring to FIG. 3, in this and other embodiments, the frame 62 includes support arms 84 and 86 to help a respective one of the platforms 52 and 54 support their respective rolls 32 and 42. To allow the un-interleaver apparatus 40 to unwind a variety of different rolls 32 each having different sheet-widths, each of the arms 84 and 86 are mounted to the frame 60 such that each may be moved in the directions indicated by the two-headed arrows 64.

Figure 6:
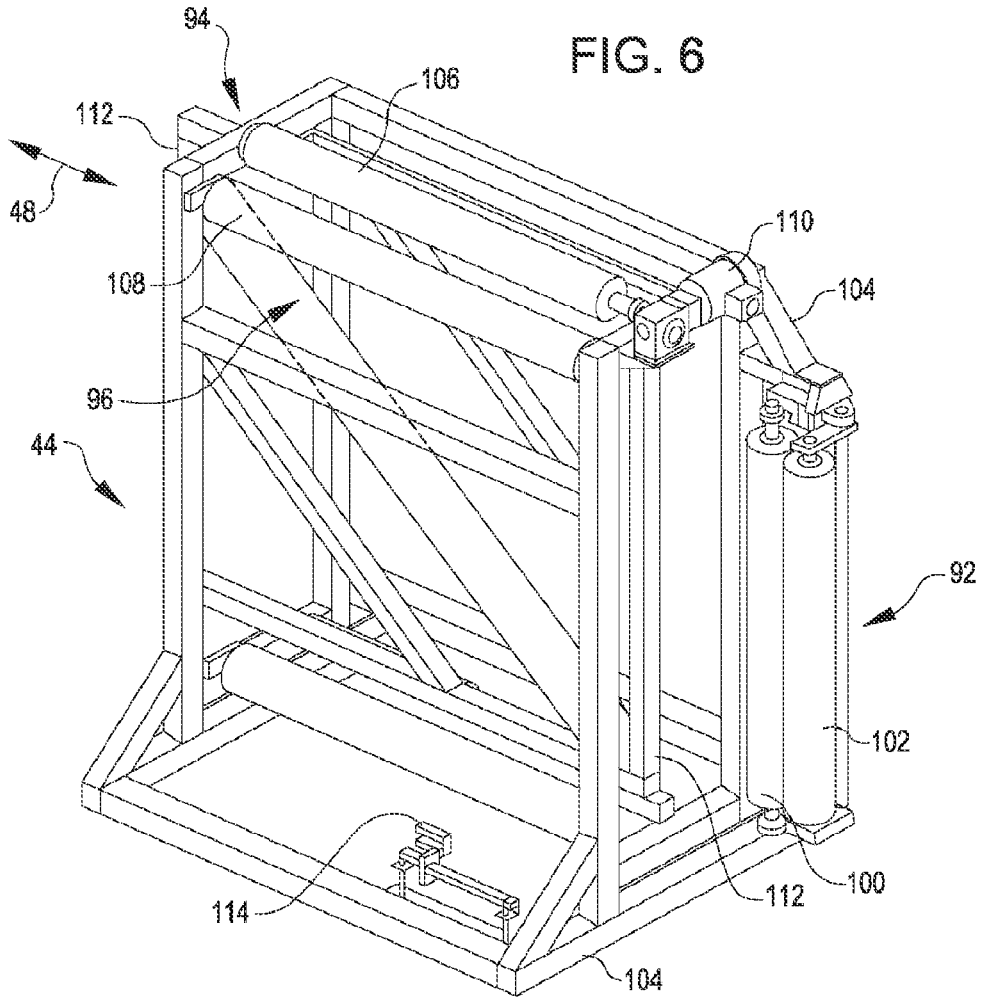
FIG. 6 is a perspective view of a turnbar included in the system shown in FIG. 2, according to an embodiment of the invention.

FIG. 6 is a perspective view of a turnbar apparatus 44 shown in FIG. 2, according to an embodiment of the invention. The turnbar apparatus 44 changes the orientation of the sheet of material 34 from a first orientation, such as vertical as shown in FIG. 2, to a second orientation, such as horizontal as shown in FIG. 2, by supporting the sheet of material 34 in a third orientation, such as halfway between the vertical and horizontal orientations, that is intermediate to the first and second orientations.

In this and other embodiments, the turnbar apparatus 44 includes a first roller 92, a second roller 94, and a turnbar-roller 96 disposed between the first roller 92 and the second roller 94. The first roller 92 is configured to support the sheet of material 34 in the first orientation as the material 34 travels from a first location, such as the un-interleaver apparatus 40, toward a second location, such as a heating oven. The second roller 94 is configured to support the sheet of material 34 in a second orientation, as the material travels toward the second location. Although the first orientation is shown as vertical and the second orientation is shown as horizontal, each of these orientations may be any desired orientation. The turnbar-roller 96 is configured to support the sheet of material 34 in a third orientation that is intermediate to the first and second orientations. The turnbar roller 96 is also movable relative to the first roller 92 in the directions indicated by the two-headed arrow 48 to maintain a predetermined tension in the sheet of material 34, as the material 34 travels toward the second location.

By supporting the sheet of material 34 in a third orientation that is intermediate to the first and second orientations, one can more easily change the orientation of the sheet 34 to an orientation that is substantially different than the first orientation. And, by moving the turnbar-roller 96 relative to the first roller 92, one can increase and/or decrease tension in the sheet of material 34 to maintain a predetermined tension in the sheet, as the material 34 travels toward the second location. In addition, by moving the turnbar-roller relative to the first roller, one can use the turnbar apparatus 44 to change the orientation of a variety of different sheets 34, each having different widths, without changing the location of each sheet's centerline 98 (shown in FIGS. 7 and 8). For example, one may use the turnbar apparatus 44 to change the orientation of a sheet whose width is 51 inches (shown in FIG. 8) and whose centerline 98 is located in the middle of the second roller 94. Then, after that is completed, one may move the turnbar-roller away from the first roller 92 and use the turnbar apparatus 44 to change the orientation of a sheet whose width is 24 inches (shown in FIG. 7) and whose centerline 98 is also located in the middle of the second roller 94.

The first roller 96 may be any desired roller capable of supporting the sheet of material 34 in the first orientation. For example, in this and other embodiments, the first roller includes a tension-roller 100 and a nip-roller 102. The tension-roller 100 is similar to the roller 78 in the un-interleaver apparatus 40 previously discussed. The tension-roller 100 is mounted to the frame 104 and measures the tension in the material 34 as the material travels toward the turn bar-roller 96. The nip-roller 102 urges the sheet of material 34 against the tension-roller 100 to help keep the sheet 34 from moving up and down along the longitudinal axis of the tension-roller 100. When the tension in the material 34 exceeds a predetermined tension, then the turn-bar-roller 96 may be moved toward the tension-roller 100. When the tension in the material 34 falls below the predetermined tension, then either, the speed of the material leaving the turnbar apparatus 44 may be increased, the speed of the material entering the turnbar apparatus may be decreased, or both.

The second roller 94 may be any desired roller capable of supporting the sheet of material 34 in the second orientation. For example, in this and other embodiments the second roller 94 includes a conventional drive-roller 106, a conventional idler-roller 108, and a conventional electric motor 110 to rotate the drive-roller 106. Similar to the tension-roller 100, the drive-roller 106 and the idler-roller 108 are each mounted to the frame 104.

Still referring to FIG. 3, the turnbar-roller 96 may be any desired roller capable of supporting the sheet 34 in the orientation that is intermediate to the first and second orientation. Moreover, the turnbar-roller 96 may be positioned as desired to support the sheet 34 in any desired intermediate orientation. For example, in this and other embodiments, the turnbar-roller 96 includes a single, conventional idler-roller that is mounted to the frame 112, which is moveable relative to the frame 104. In addition, the single idler-roller is clocked 45 degrees or halfway between the vertical first-orientation and the horizontal second-orientation. In other embodiments, the turnbar roller 96 includes two or more conventional, idler-rollers, each supporting the sheet of material 34 in a respective one of two intermediate orientations. In still other embodiments, the turnbar-roller 96 may not include a roller, but rather a surface that the sheet of material slides across.

In this and other embodiments, the turnbar apparatus 44 also includes an edge-sensor 114. The edge-sensor 114 may be any desired sensor capable of generating a signal that a controller (not shown) can use to determine whether or not the edge of the material 34 traveling toward the second location is positioned as desired. For example, in this and other embodiments, the edge-sensor 58 includes a conventional sensor (not shown) that senses changes in the location of the edge by monitoring changes in the light reflected from the edge.

Still referring to FIG. 3, the turnbar apparatus 44 also includes a controller (not shown) that is similar to the controller in the un-interleaver apparatus 40 previously discussed. The controller may be any desired controller capable of processing the signals from the tension-roller 100 and the edge-sensor 114, and in response, directing changes to the operation of the turnbar apparatus 44. For example in this and other embodiments, the controller 60 may be a computer that includes memory circuitry, a processor, and software that the processor runs to perform its monitoring, determining, and directing functions. In other embodiments, the controller 60 may be used to control the turnbar apparatus 44.

The preceding discussion is presented to enable a person skilled in the art to make and use the invention. Various modifications to the embodiments will be readily apparent to those skilled in the art, and the generic principles herein may be applied to other embodiments and applications without departing from the spirit and scope of the present invention. Thus, the present invention is not intended to be limited to the embodiments shown, but is to be accorded the widest scope consistent with the principles and features disclosed herein.

What is claimed is:

1. A turnbar apparatus for changing an orientation of a sheet of material as the sheet of material travels from a first location toward a second location, the turnbar apparatus comprising:

a first roller configured to support the sheet of material in a first orientation as the sheet of material travels from the first location toward the second location;

a second roller configured to support the sheet of material in a second orientation, as the sheet of material travels toward the second location;

a turnbar-roller:

disposed between the first roller and the second roller;

configured to support the sheet of material in a third orientation that is intermediate to the first and second orientations, as the sheet of material travels toward the second location; and movable relative to the first roller as the sheet of material travels toward the second location;

a tension sensor operable to generate a signal that represents an amount of tension in the sheet of material as the sheet of material travels toward the second location;

an edge sensor operable to generate a signal that represents a position of an edge of the sheet of material as the sheet of material travels toward the second location; and a controller operable to monitor the signal generated by the tension sensor and the edge sensor and to cause the turnbar-roller to move relative to the first roller as the sheet of material travels toward the second location.

2. The turnbar apparatus of claim 1 wherein the first roller and the second roller are each mounted to a first frame.

3. The turnbar apparatus of claim 1 wherein the first roller is configured to prevent the sheet of material from moving in a direction transverse to a direction of travel of the sheet of material.

4. The turnbar apparatus of claim 1 wherein the second roller is configured to urge the sheet of material toward the second location.

5. The turnbar apparatus of claim 1 wherein the turnbar-roller is mounted to a frame, and the frame moves relative to the first roller as the sheet of material travels toward the second location.

6. The turnbar apparatus of claim 1 wherein the turnbar apparatus includes only one turnbar-roller.

7. The turnbar apparatus of claim 1 wherein the third orientation is provided at an angle that is halfway between the first orientation and the second orientation.

8. The turnbar apparatus of claim 1 wherein the turnbar-roller is movable relative to the first roller to maintain a position of a centerline of the sheet of material traveling in the second orientation when a width of the sheet of material changes.

9. The turnbar apparatus of claim 1 wherein the turnbar-roller is movable relative to the first roller to maintain a position of a centerline of the sheet of material or the position of the edge of the sheet of material as the sheet of material travels toward the second location.

10. The turnbar apparatus of claim 1 wherein the controller is operable to cause the turnbar-roller to move relative to the first roller as the sheet of material travels toward the second location in response to the signal generated by the edge sensor.

11. A method for changing an orientation of a sheet of material as the sheet of material travels from a first location toward a second location, the method comprising:

supporting the sheet of material in a first orientation as the sheet of material travels from the first location toward the second location;

supporting the sheet of material in a second orientation as the sheet of material travels toward the second location;

with a turnbar-roller, supporting the orientation of the sheet of material in a third orientation that is intermediate to the first and second orientations, as the sheet of material travels toward the second location;

determining a tension in the sheet of material, as the sheet of material travels toward the second location;

determining a position of an edge of the sheet of material as the sheet of material travels toward the second location; and moving the turnbar-roller relative to the first location as the sheet of material travels toward the second location.

12. The method of claim 11 wherein supporting the sheet of material in the first orientation includes preventing the sheet of material from moving in a direction transverse to a direction of travel of the sheet of material.

13. The method of claim 11 wherein supporting the sheet of material in the second orientation includes urging the sheet of material toward the second location.

14. The method of claim 11 wherein the third orientation is provided at an angle that is halfway between the first orientation and the second orientation.

15. The method of claim 11 wherein the third orientation is the only intermediate orientation.

16. The method of claim 11 wherein the moving the turnbar-roller relative to the first location as the sheet of material travels toward the second location maintains a position of a centerline of the sheet of material or the position of the edge of the sheet of material as the sheet of material travels toward the second location.

17. The method of claim 11 wherein the moving the turnbar-roller relative to the first location as the sheet of material travels toward the second location occurs in response to the determining the position of the edge of the sheet of material.

18. A turnbar apparatus for changing an orientation of a sheet of material as the sheet of material travels from a first location toward a second location, the turnbar apparatus comprising:

a first roller configured to support the sheet of material in a first orientation as the sheet of material travels from the first location toward the second location;

a second roller configured to support the sheet of material in a second orientation, as the sheet of material travels toward the second location;

a turnbar-roller:

disposed between the first roller and the second roller;

configured to support the sheet of material in a third orientation that is intermediate to the first and second orientations, as the sheet of material travels toward the second location; and movable relative to the first roller as the sheet of material travels toward the second location;

an edge sensor operable to generate a signal that represents a position of an edge of the sheet of material as the sheet of material travels toward the second location; and a controller operable to monitor the signal generated by the edge sensor and to cause the turnbar-roller to move relative to the first roller as the sheet of material travels toward the second location.

19. The turnbar apparatus of claim 18 wherein the turnbar-roller is movable relative to the first roller to maintain a position of a centerline of the sheet of material or the position of the edge of the sheet of material as the sheet of material travels toward the second location.

20. The turnbar apparatus of claim 18 wherein the controller is operable to cause the turnbar-roller to move relative to the first roller as the sheet of material travels toward the second location in response to the signal generated by the edge sensor.

* * * * *